United States Patent [19]

Kotlar

[11] 3,945,102

[45] Mar. 23, 1976

[54] METHOD AND APPARATUS FOR MAKING A SHEET METAL PULLEY

[76] Inventor: Edward A. Kotlar, 21115 Mack Ave., Grosse Pointe Woods, Mich. 48236

[22] Filed: Feb. 3, 1975

[21] Appl. No.: 546,616

[52] U.S. Cl. ..... 29/159 R; 74/230.8; 113/116 D

[51] Int. Cl.[2] ..... B21K 1/42

[58] Field of Search ..... 29/159 R; 113/1 M, 116 D; 74/230.8, 230.3, 230.5, 230.13, 230.14

[56] References Cited

UNITED STATES PATENTS

| | | | |
|---|---|---|---|
| 2,646,689 | 7/1953 | Maher | 74/230.8 |
| 2,680,380 | 6/1954 | Bagley | 74/230.8 |
| 2,729,110 | 1/1956 | Killian et al. | 74/230.8 |
| 2,741,134 | 4/1956 | Bagley | 29/159 R X |
| 2,915,908 | 12/1959 | Narnkey | 29/159 R X |
| 3,722,309 | 3/1973 | Shaffer | 29/159 R X |
| 3,722,310 | 3/1973 | Schultz, Jr. | 74/230.3 X |
| 3,772,928 | 11/1973 | Gobeille | 29/159 R X |

*Primary Examiner*—Victor A. Di Palma
*Attorney, Agent, or Firm*—Barnes, Kisselle, Raisch & Choate

[57] ABSTRACT

A method and apparatus for making a sheet metal pulley having a pair of stamped sheet metal cups with telescopically interfitted side wall portions and integral flanges forming in cooperation with the flanges of rings received on the cups a plurality of V-shaped grooves. A device which engages a side wall portion of at least one of the cups locates and produces pulley mounting holes concentric with the grooves of the pulley and extending through the bottom walls of the cups. The mounting holes are produced prior to a ring being fixed to such side wall portion by a plurality of circumferentially equally spaced spot welds in such ring and side wall portion.

11 Claims, 14 Drawing Figures

METHOD AND APPARATUS FOR MAKING A SHEET METAL PULLEY

This invention relates to pulleys and, more particularly, to a method and apparatus for the mass production of sheet metal pulleys.

In the automotive industry there has been a great demand for an inexpensive durable pulley having a long, useful life under severe service conditions such as fan and crankshaft pulleys. Examples of prior sheet metal pulleys for automotive applications are shown in United States Bagley U.S. Pat. No. 3,680,380, Bagley U.S. Pat. NO. 2,741,134 and Nelson U.S. Pat. No. 2,787,914.

Objects of this invention are to provide a method and apparatus for producing stamped sheet metal pulleys which enables economical manufacture and assembly of such pulleys, eliminates balancing operations in producing such pulleys, produces inherently balanced sheet metal pulleys, and produces sheet metal pulleys with improved concentricity and balance.

These and other objects, features and advantages of this invention will be apparent from the following description, appended claims and accompanying drawings, in which:

Figure 1:
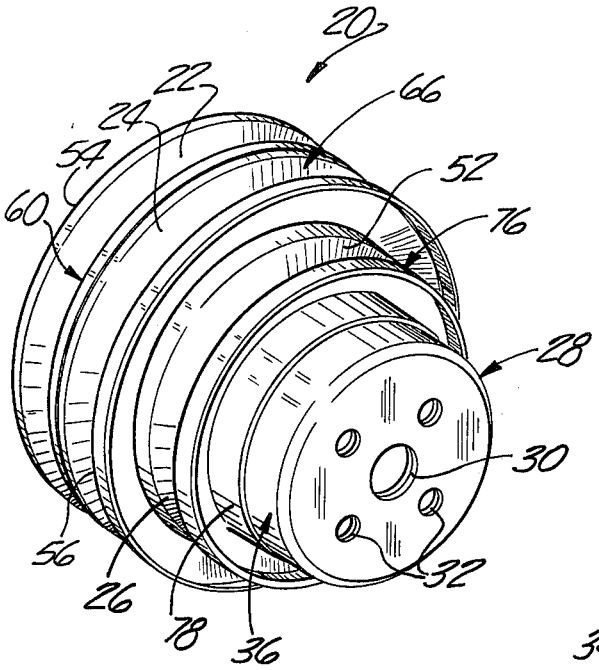
FIG. 1 is an isometric view of a pulley produced by the method and apparatus of this invention.
Figure 2:
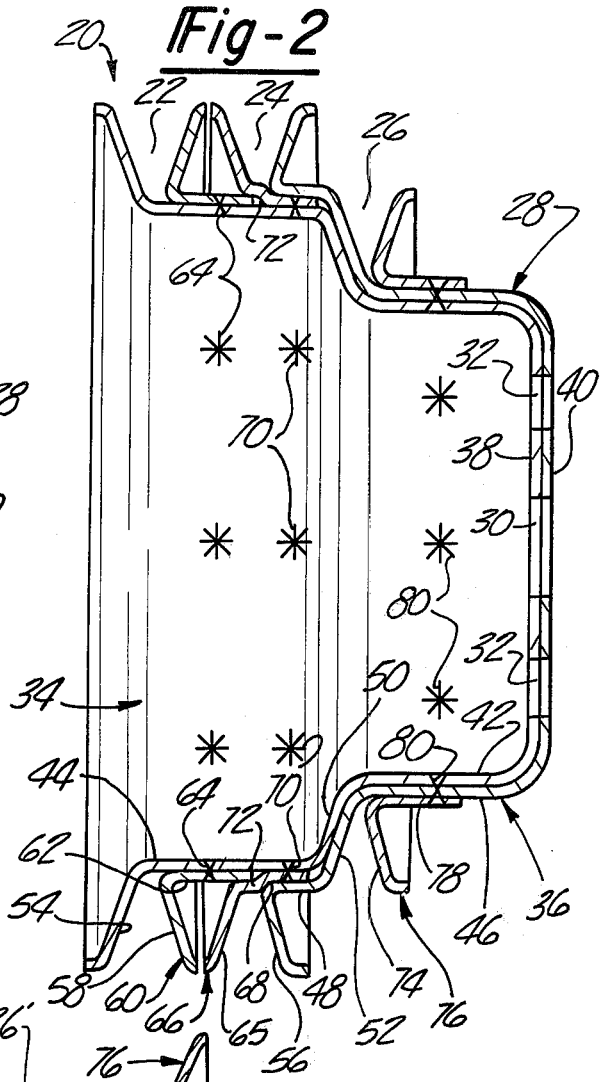
FIG. 2 is an enlarged sectional view of the pulley of FIG. 1.

FIGS. 1 and 2 illustrate a stamped sheet metal pulley 20 produced by the method and apparatus of this invention. Pulley 20 has three V-shaped grooves 22, 24, 26 and a mounting hub 28 with an axial pilot hole 30 and four equally circumferentially spaced mounting holes 32 therethrough. Pulley 20 has a pair of telescopically interfitted inner and outer cup members 34, 36 each having radially extending bottom walls 38, 40 radially offset axially extending side wall portions 42, 44 and 46, 48 integrally interconnected by intermediate inclined wall portions 50 and 52, and inclined flanges 54 and 56.

Groove 22 of pulley 20 is formed by cooperation of inclined flange 54 with the inclined flange 58 of a first ring 60 having an integral axially extending base 62 fixed to wall portion 44 of inner cup 34 by a plurality of equally circumferentially spaced spot welds 64. Likewise, groove 24 is formed by cooperation of inclined flange 56 of outer cup 36 with the inclined flange 65 of a second ring 66 having an axially extending base 68 fixed to side wall portion 44 of inner cup 34 by a plurality of circumferentially spaced spot welds 70. To provide clearance for the edge of the base of ring 60, the base 68 of ring 66 has an offset portion 72 therein. Similarly, groove 26 is formed by cooperation of inclined wall portion 52 of outer cup 36 with an inclined flange 74 of a ring 76 having an axially extending base 78 fixed to side wall portion 46 of outer cup 36 by a plurality of circumferentially equally spaced spot welds 80.

Figure 3:
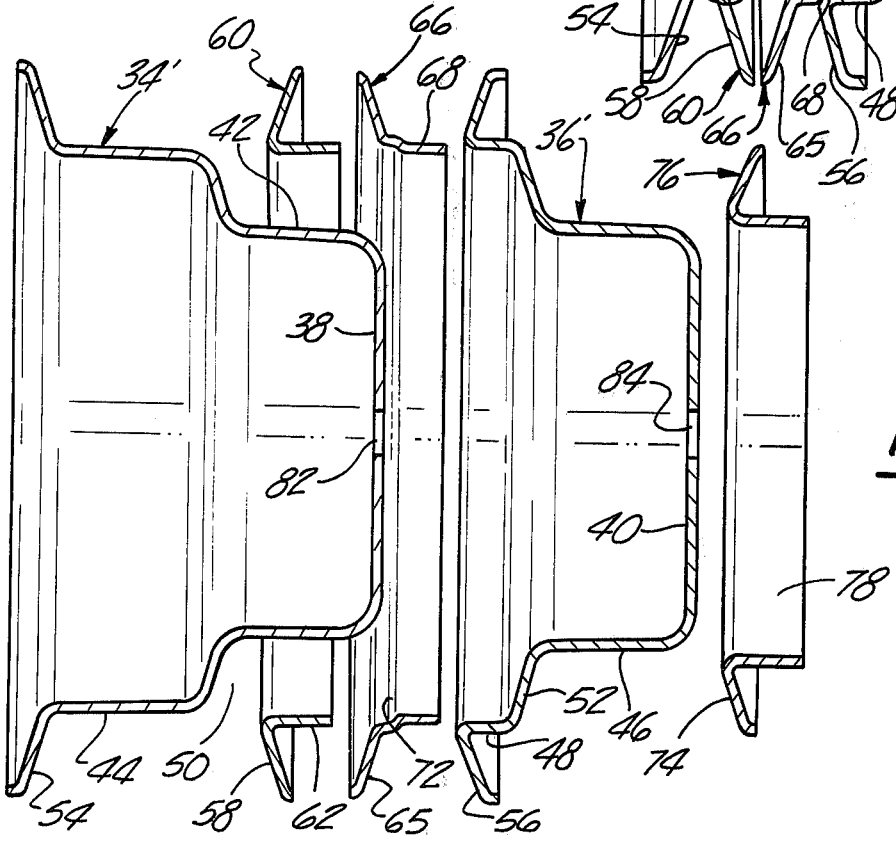
FIG. 3 is an exploded sectional view of the sheet metal stampings forming the pulley of FIG. 1 prior to processing and assembly thereof by the method and apparatus of this invention.

In accordance with the method of this invention, cups 34′ and 36′ and rings 60, 66, and 76 (FIG. 3) are stamped by cold forming press operations from sheet metal, such as 1008 steel, and vent holes 82 and 84 are pierced through the bottom walls of cups 34′ and 36′. Each ring 60, 66, and 76 is formed so that its base has a slight interference fit with the side wall portion of its associated cup, and cups 34′ and 36′ are formed so that the side wall portions 42 and 46 thereof have a slight interference fit. IN accordance with the method of this invention, rings 60 and 66 are press fit onto the outer periphery of side wall portion 44 of cup 34′ and fixed thereto by spot welds 64 and 70 to provide a subassembly onto which outer cup 36′ is press fit and ring 76 is press fit over outer cup 36′. Pilot hole 30 and mounting holes 32 are pierced through the bottom walls of cup 34′ and 36′ of the resulting subassembly of rings and cups with the piercing die utilizing the inner peripheral surface of side wall portion 42 of cup 34′, or the outer peripheral surface of side wall portion 46 of cup 36′, or both, to assure that pilot hole 30 and mounting holes 32 are concentrically located with respect to the axis of rotation of grooves 22, 24, 26 of the completed pulley 20. Thereafter, both of the cups and ring 76 are fixed together by a plurality of circumferentially spaced spot welds 80 to provide a completely finished pulley 20.

Figure 4:
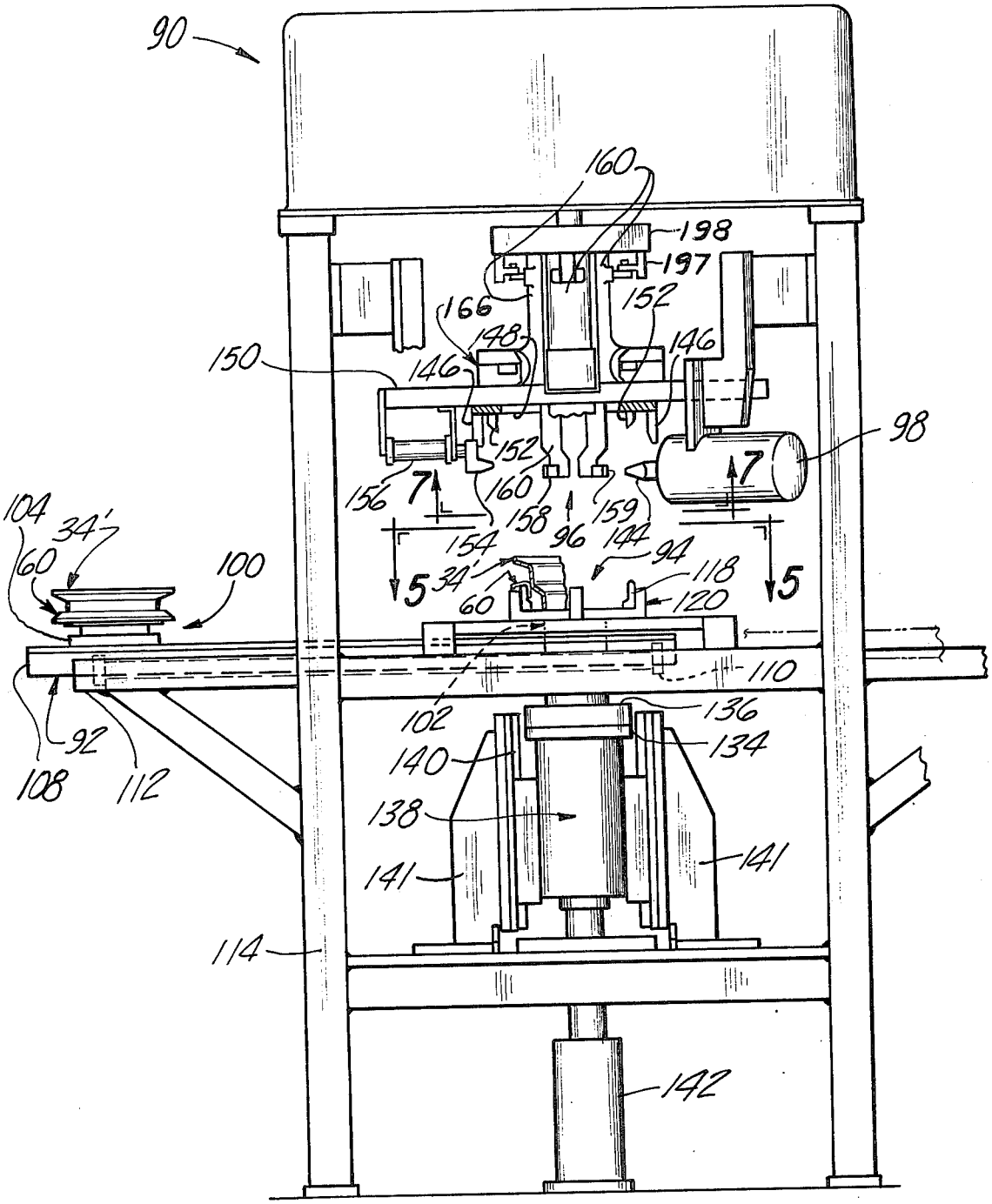
FIG. 4 is a side view, partly in section, of a first spot welding apparatus for performing a portion of the method of this invention showing the carrier assembly of the apparatus in a partially raised position.
Figure 5:
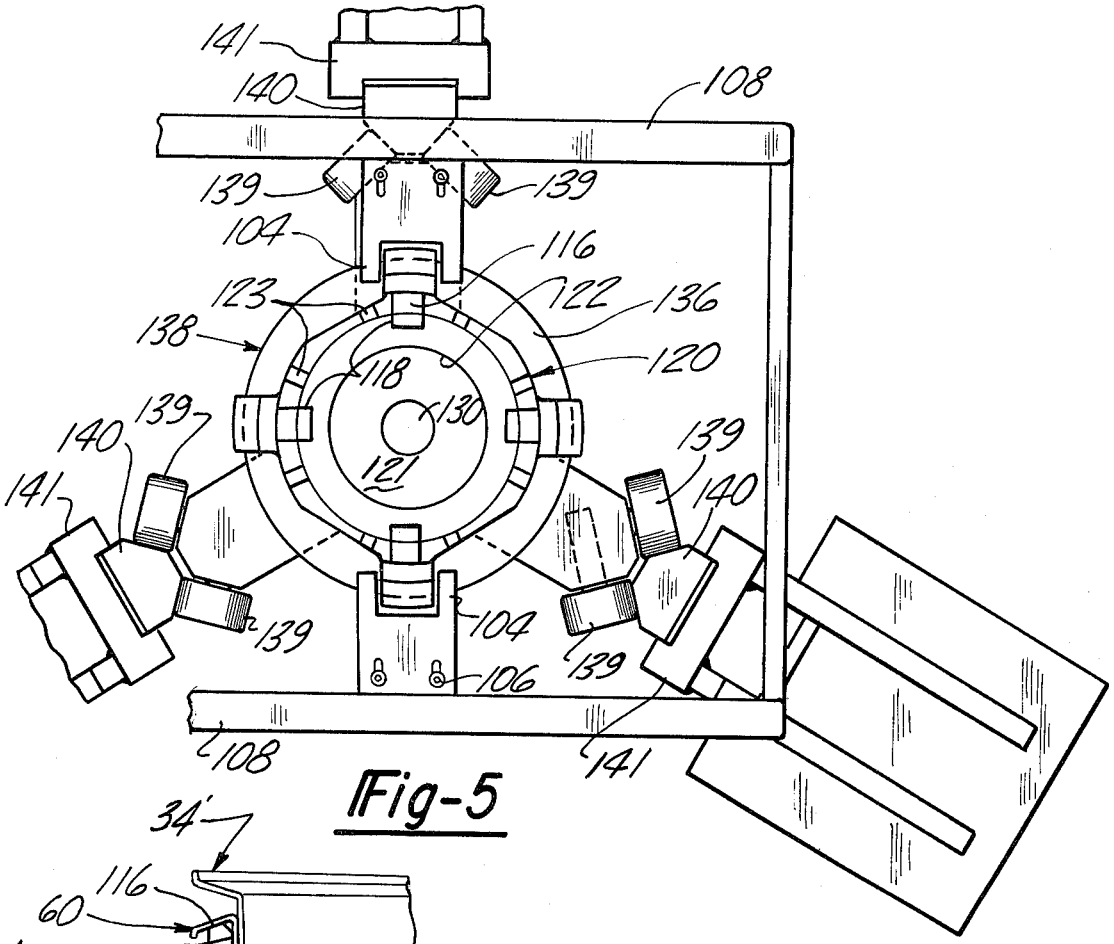
FIG. 5 is a fragmentary view, partly in section, on line 5—5 of FIG. 4 illustrating the shuttle and carrier assembly of the apparatus of FIG. 4.

A suitable apparatus 90 for pressing ring 60 onto cup 34′ and spot welding the ring to the cup in accordance with the method of this invention is illustrated in FIGS. 4 through 9. As shown in FIG. 4, ring 60 with an associated cup 34′ loosely received thereon is transferred by a shuttle 92 into apparatus 90 and moved upwardly by a carrier assembly 94 onto a mandrel assembly 96 to press ring 60 onto cup 34′ and correctly position the ring and cup relative to welding guns 98 for spot welding the ring to the cup. As shown in FIGS. 4 and 5, shuttle 92 has two workpiece support stations 100 and 102 in which rings 60 are suspended by underlying fingers 104 of plates (FIG. 5) adjustably secured by cap screws 106 to a rectangular frame 108 reciprocated by a pneumatic cylinder 110 on way 112 secured to the frame 114 of apparatus 90.

Figure 6:
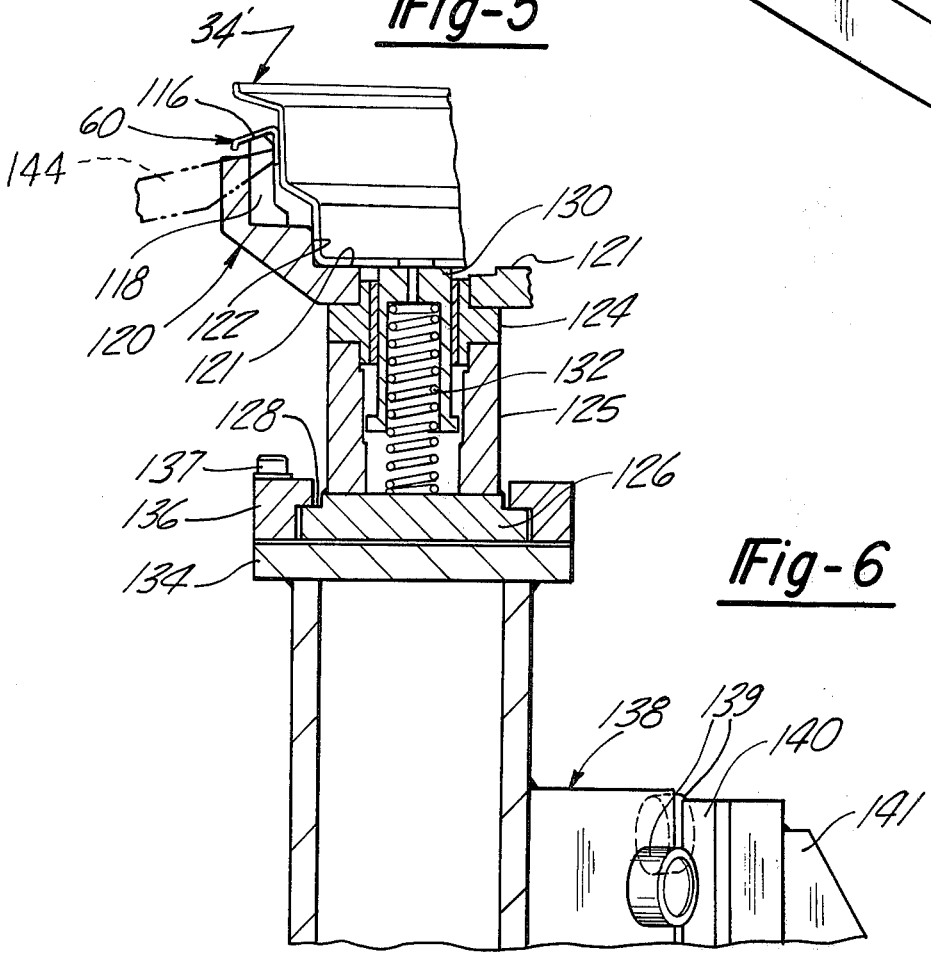
FIG. 6 is a fragmentary side view, partly in section, of the carrier assembly of FIG. 4.

As shown in FIGS. 5 and 6, carrier assembly 94 receives and retains each ring 60 on the upper inclined edges 116 of a plurality of underlying circumferentially spaced supports 118, each adjustably secured in a carrier ring 120. To center and support the cup in carrier ring 120, the ring has a bottom wall 121 and an axially extending cylindrical wall 122 adapted to bear on the bottom 38 and outer periphery of side wall portion 42 of cup 34' when the cup is fully received in carrier ring 120. To provide clearance for the tips of welding guns 98 to engage ring 60, carrier ring 120 has a plurality of equally circumferentially spaced slots 123 therethrough. Carrier ring 120 is fixed by a coller 124 to the upper end of a tubular support 125, the lower end of which is fixed to a cylindrical base plate 126 with a continuous shoulder 128 therein. After welding of ring 60 to cup 34', the cup is disengaged from cylindrical wall 122, as the carrier assembly is lowered, by an ejector plunger 130 slideably received in collar 124 and yieldably biased to its extended position by a coil spring 132. Carrier ring 120 and tubular support 125 are mounted on a movable platen 134 to float or shift generally radially with respect to the platen within predetermined limits by a retainer ring 136 secured to the platen by cap screws 137. Movable platen 134 is fixed to a carriage 138 guided by rollers 139 bearing on three circumferentially equally spaced ways 140 secured to supports 141 fixed to frame 114, and is raised and lowered by a pneumatic cylinder 142 (FIG. 4).

Figure 7:
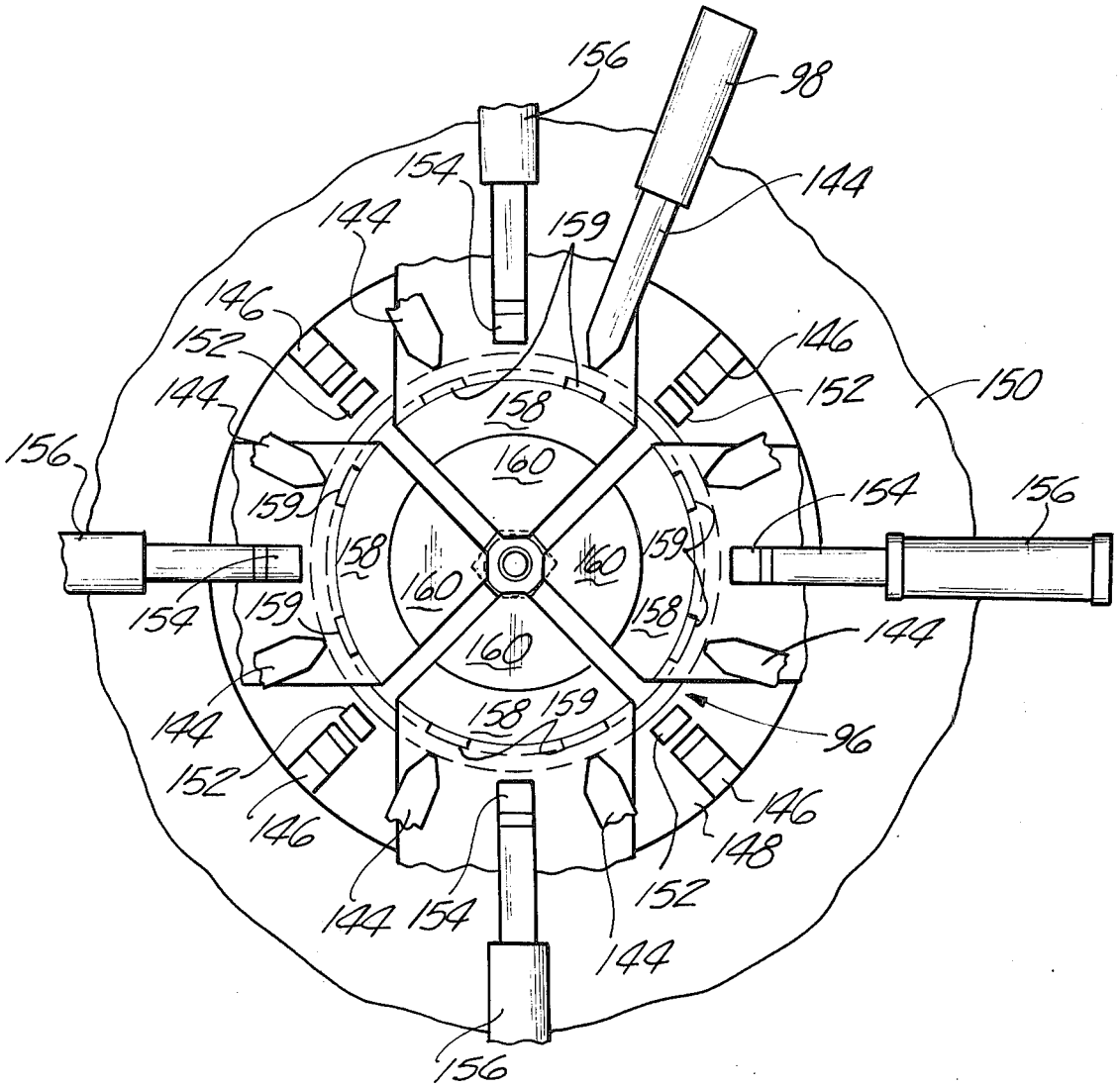
FIG. 7 is a fragmentary view, partly in section, on line 7—7 of FIG. 4 illustrating the mandrel assembly of the apparatus of FIG. 4.

As shown in FIGS. 4 and 7, ring 60 is spot welded to cup 34' by eight welding guns 98 with movable tips 144 which are equally circumferentially spaced around mandrel assembly 96. As carrier assembly 94 is raised, floating carrier ring 120 is positioned so that it is coaxial with mandrel assembly 96 by engagement with four equally circumferentially spaced locators 146 secured to a retainer ring 148, which is fastened to a fixed upper platen 150. The extent to which cup 34' can be moved vertically upward over mandrel assembly 96 is limited by stops 152 secured to retainer ring 148. When cup 34' and ring 60 are received over mandrel assembly 96 the flanges 54 and 58 thereof are respectively urged into firm engagement with stops 152 and the upper edge of support 118 of carrier ring 120 by four wedges 154 equally circumferentially spaced around mandrel assembly 96 and extended and retracted generally radially by pneumatic cylinders 156 fixed to platen 150. Four electrodes 158 with pressure pads 159 generally aligned with electrode tips 144 are moved generally radially outwardly into engagement with the inner periphery of wall portion 44 of cup 34' by four arms 160 of mandrel assembly 96.

Figure 8:
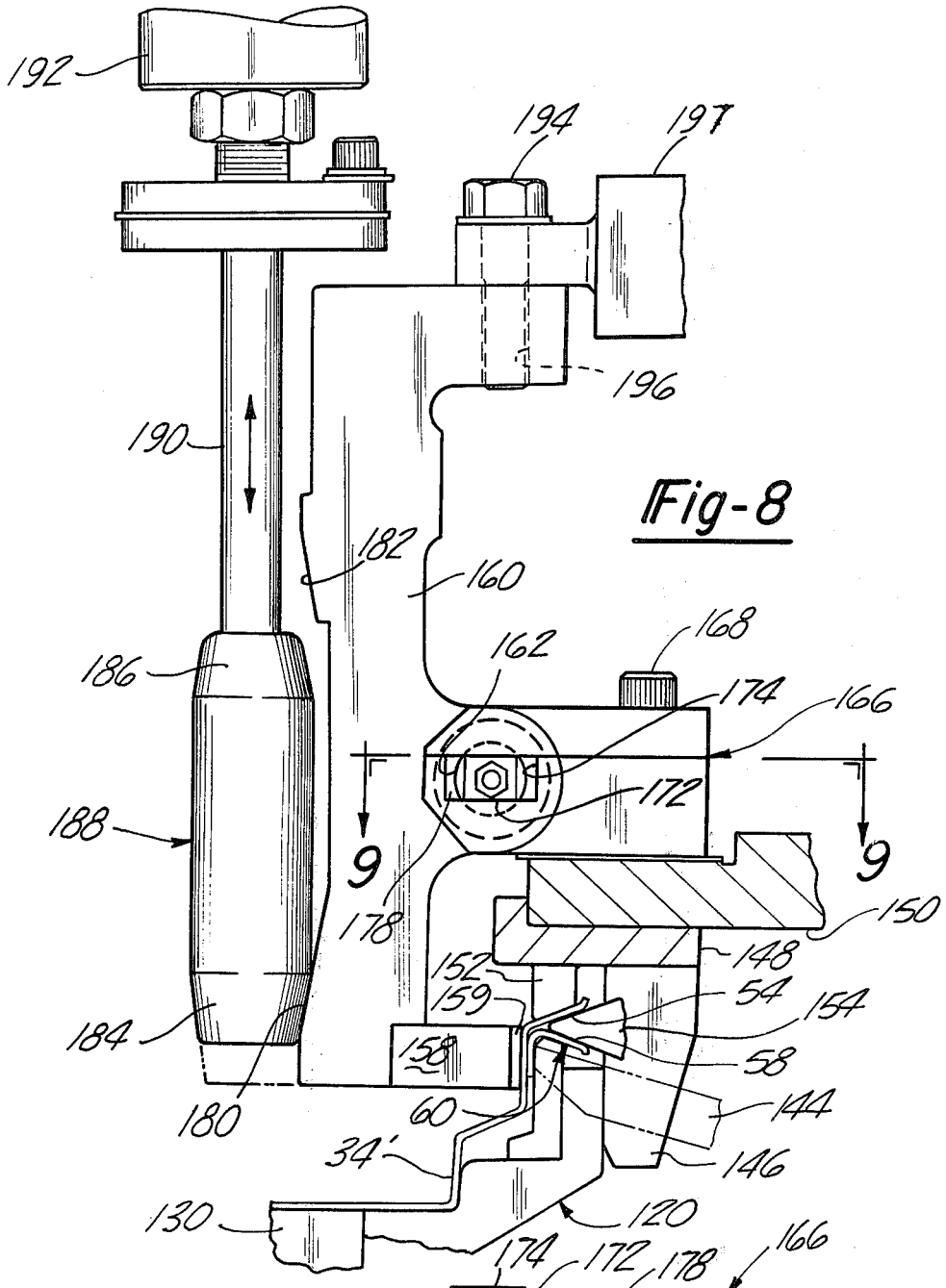
FIG. 8 is a fragmentary side view in section of the mandrel assembly of FIG. 7.
Figure 9:
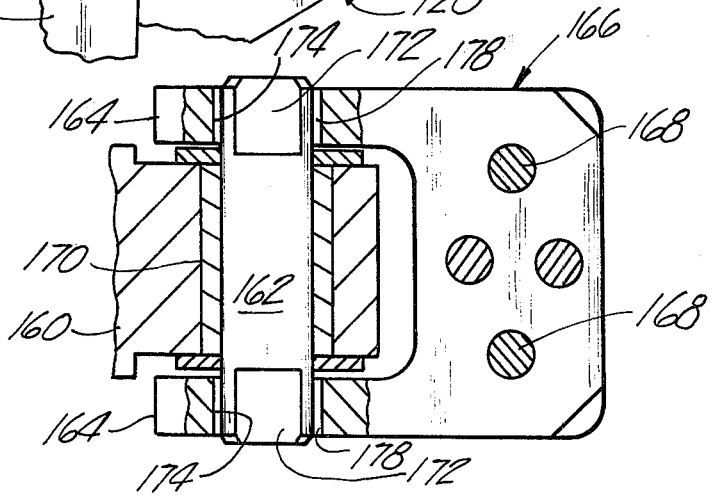
FIG. 9 is a sectional view on line 9—9 of FIG. 8 illustrating the pivotal mounting of the arms of the mandrel assembly of the apparatus of FIG. 4.

As shown in FIGS. 8 and 9, each arm 160 of mandrel assembly 96 is pivotally mounted on upper platen 150 by a pin 162 received in the fingers 164 of yoke 166 secured by cap scews 168 to platen 150. Each pin 162 extends through a bushing 170 in arm 160 and has flats 172 on its opposed ends which are received in elongated rectilinear slots 174 through the fingers 164 of yoke 166. To assure that both pressure pads 159 of the electrode 158 carried by each arm will always engage cup 34', each arm 160 is permitted to rock or move within predetermined limits in an arc lying in a plane transverse to the axis of a cup 34' received on mandrel assembly 96 by a space or clearance 178 between the pin and the end wall of slot 174. Clearance 178 is provided by making the length of each slot 174 exceed the diameter of pin 162. The lower end of each arm 160 is moved generally radially to extend and retract electrodes 158 by the cooperation of inclined surfaces 180 and 182 on the arm with conical surfaces 184 and 186 on a cam 188 fixed to the lower end of an actuator rod 190 which is extended and retracted by a pneumatic cylinder 192. The extent of the pivotal movement of each arm 160 is limited by a reduced diameter stop pin 194 extending into an enlarged hole 196 in the upper end of the arm. Stop pin 194 is received in a bracket 197 secured to a plate 198 fixed to frame 114.

In using welding apparatus 90, shuttle 92 is fully retracted and a ring 60 is placed on the fingers 104 of station 100 and then a cup 34' is placed on top of the ring. The shuttle is extended by cylinder 110 to position ring 60 and cup 34' over ring 120 of carrier assembly 94 which is extended by cylinder 142 from below shuttle 92 to pick up ring 60 and cup 34' from shuttle 92 which is then retracted by cylinder 110. As ring 60 and cup 34' are moved upward by carrier assembly 94, flange 54 of the cup bears on stops 152 and the continued upward movement of carrier assembly 94 presses ring 60 upwardly onto side wall 44 of the cup until the bottom wall 121 of carrier ring 120 bears on the bottom 38 of the cup. As carrier assembly 94 becomes fully extended, carrier ring 120 is centered around mandrel assembly 96 by locators 146, cup 34' is positively located and centered within the carrier ring 120 by its bottom wall 121 and side wall 122, and plunger 130 is depressed by the bottom wall 38 of the cup.

Wedges 154 are extended by cylinders 156 to frimly retain the flanges of cup 34' and ring 60 is engagement with stops 152 and supports 118, and electrodes 158 are extended to bear on cup 34' by energizing cylinder 192 to cam the lower end of arms 160 of the mandrel assembly generally radially outward by engagement of conical surface 184 of cam 188 with inclined surfaces 180 on the arms. The tips 144 of welding guns 98 are extended into engagement with portions of the base of ring 60, and the guns are energized to produce spot welds 64, thereby fixing ring 60 to cup 34'. Upon completion of the spot welds, tips 144 of the welding guns are retracted, and electrodes 158 are disengaged from the cup 34' by cylinder 192 of the mandrel assembly. Wedges 154 are retracted by cylinders 156 and carrier assembly 94 is lowered by cylinder 142. As carrier assembly 94 is lowered cup 34' with ring 60 welded thereto is disengaged from side wall 122 of carrier ring 120 by extension of plunger 130 by spring 132, and the ring with the cup welded thereto is deposited on fingers 104 in station 102 of shuttle 92. When carrier assembly 94 is fully retracted below shuttle 92, the shuttle is extended to transfer both the cup 34' with ring 60 welded thereto out of apparatus 90 and another ring 60 with another cup 34' loosely received thereon into welding apparatus 90, thereby commencing another cycle of operation of the apparatus.

Figure 10:
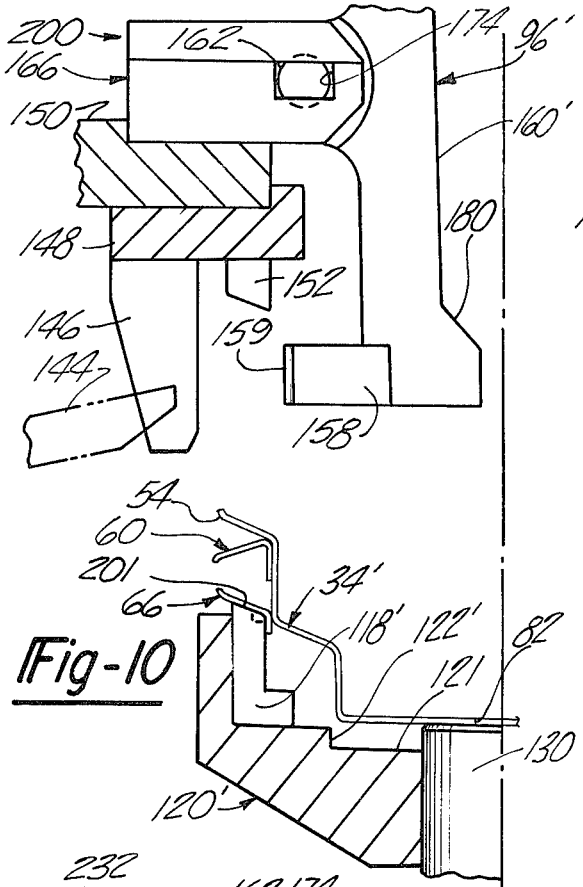
FIGS. 10 and 11 are semi-diagrammatic fragmentary, sectional, side views of a second welding apparatus for performing a portion of the method of this invention with the carrier assembly shown in the lowered and raised positions, respectively.
Figure 11:
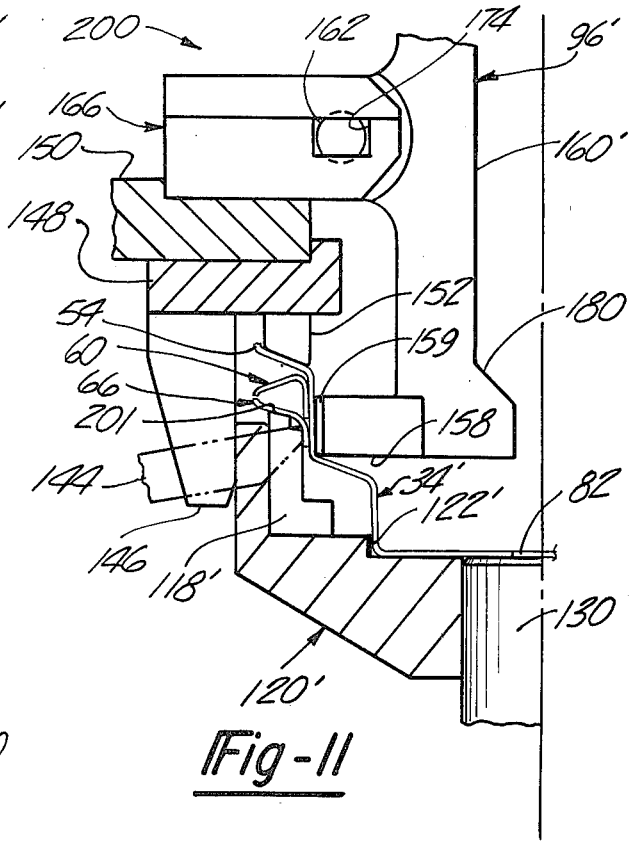

FIGS. 10 and 11 illustrate an apparatus 200 for pressing a ring 66 on and welding it to a cup 34' with a ring 60 already welded thereto in accordance with the method of this invention. Apparatus 200 is generally the same as apparatus 90 and thus, the description of identical component parts which have the same reference numbers will not be repeated. Apparatus 200 does not have any wedges 154 and associated pneumatic cylinders 156, and the arms 160' of mandrel assembly 96' extend to a lower level than the corresponding arms 160 of apparatus 90 to align pressure pads 159 of electrodes 158 with the base 68 of ring 66. Similarly, welding guns 98 (not shown in FIGS. 10 and 11) are mounted at a lower position to align their electrode tips 144 with the base of ring 66 and pressure pads 159 of electrodes 158. The cup 34' is positively located and centered in a modified carrier ring 120' by bottom wall 121 and side wall 122', when the cup is fully received in the carrier ring. Modified supports 118' are adjustably secured in ring 120' and have upper edges 201 bearing on flange 65 of ring 66 to locate the ring in the desired position on cup 34'. The loaded position and welding position of the component parts of apparatus 200 is shown in FIGS. 10 and 11 respectively, and the operation of apparatus 200 is the same as apparatus 90, except that there are no wedges 154 and actuating cylinders 156 to be cycled.

Figure 12:
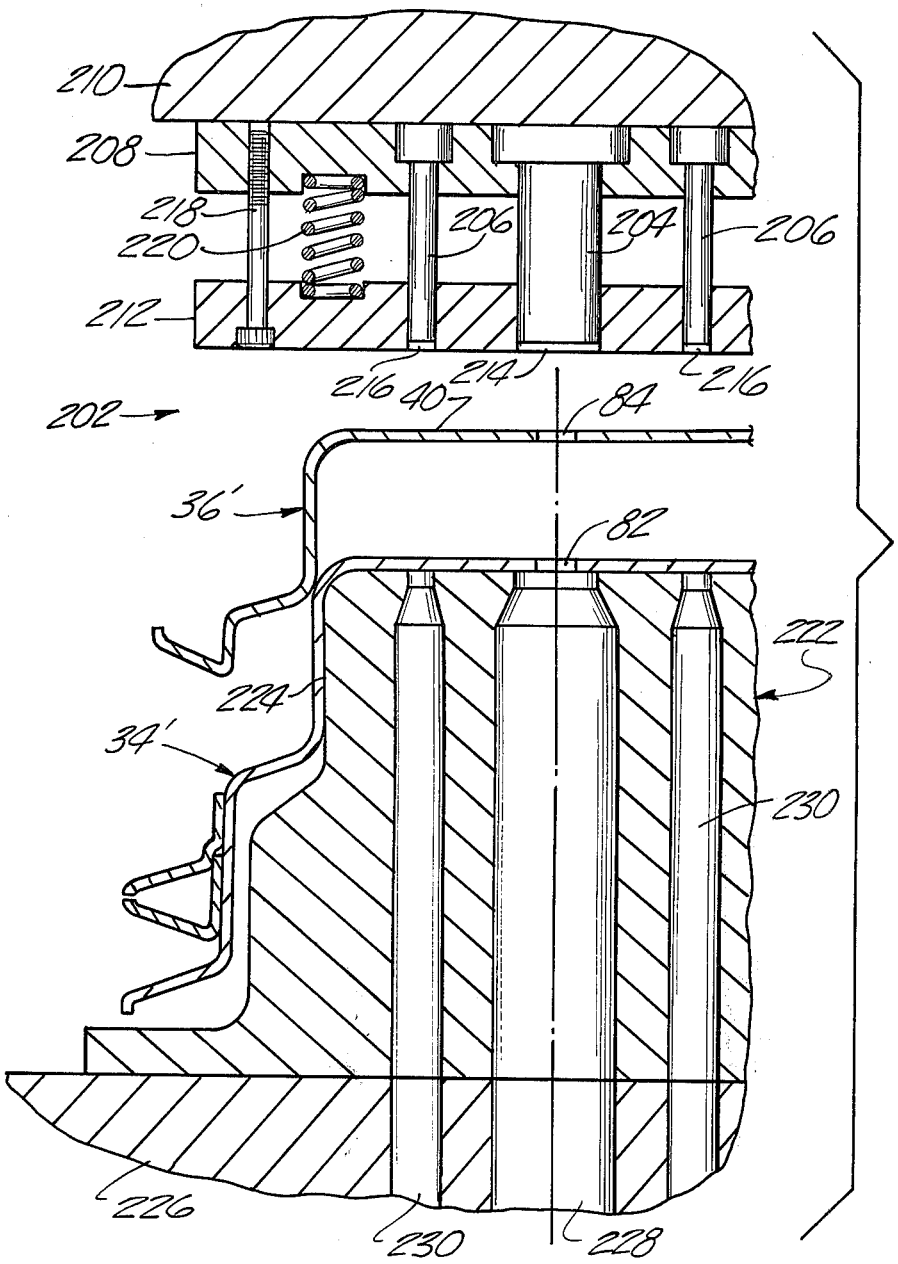
FIG. 12 is a side view in section of a die assembly for performing a portion of the method of this invention.

FIG. 12 illustrates a die assembly 202 for pressing cups 34' and 36' together and piercing holes 30 and 32 through the bottom portions of the cups. Die assembly 202 has a center punch 204 and four equally circumferentially spaced punches 206 for piercing holes 30 and 32 through the cups. The punches are mounted by a carrier plate 208 on a punch holder 210 of a die set, the guide pins of which are not shown. A combined pressure and stripped plate 212 with holes 214 and 216 therethrough for slideably receiving the punches is movably mounted on carrier plate 208 by guide pins 218 with enlarged heads received in counter bores for retaining the plate on the pins. The stripper plate 212 is yieldably biased away from carrier plate 208 by a plurality of compression springs 220 which develop sufficient force to assure that the die assembly 202 fully presses cup 36' onto cup 34' before the punches pierce holes 30 and 32 through the cups. Cup 34' is located on a die button 222 in concentric relation with center punch 204 by a cylindrical side wall 224 of the die button. The die button 222 is fixed to a shoe 226 of the die set. Passages for the slugs pierced from the cups by the punches are provided by central clearance hole 228 and four circumferentially spaced clearance holes 230 through the die button 222 and die show 226.

In using die assembly 202 cup 34' is placed over die button 222 and cup 36' is positioned on top of cup 34' as shown in FIG. 12. The punch holder 210 of the die set is extended toward the die button by the ram of a press (not shown) in which the die set is received to move plate 212 into engagement with the bottom wall portion 40 of cup 36' to press the cups together. As the down stroke of the ram of the press continues, springs 220 are compressed and punches 204 and 206 are extended into die button 222 to pierce holes 30 and 32 through the cups. On the up stroke of the press plate 212 strips the subassembly of cups 34' and 36' from punches 204 and 206 and when the punches are fully retracted the subassembly of cups may be removed from die assembly 202.

Figure 13:
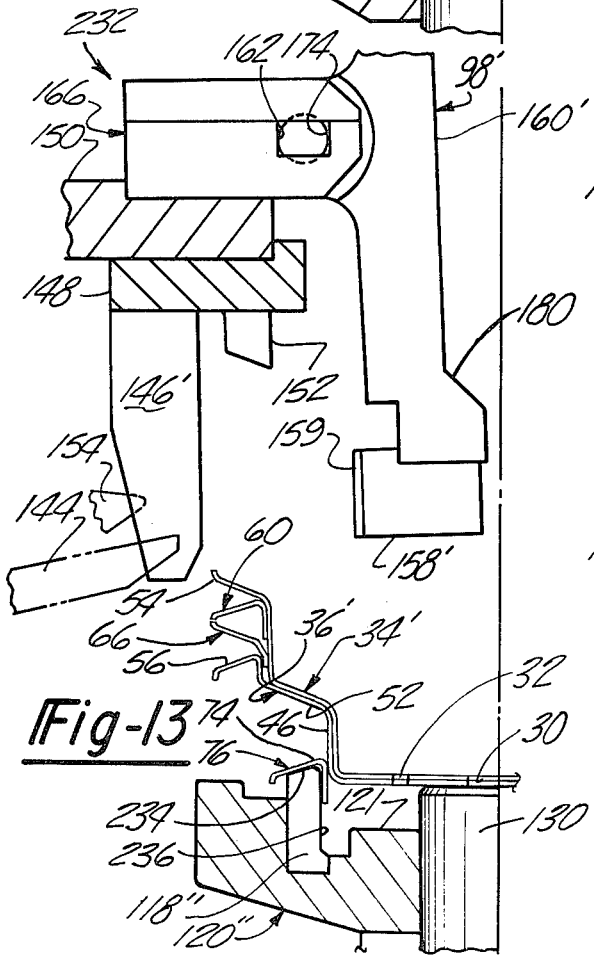
FIGS. 13 and 14 are semi-diagrammatic, fragmentary, sectional, side views of a third welding apparatus for performing a portion of the method of this invention with the carrier assembly shown in the lowered and raised positions, respectively.
Figure 14:
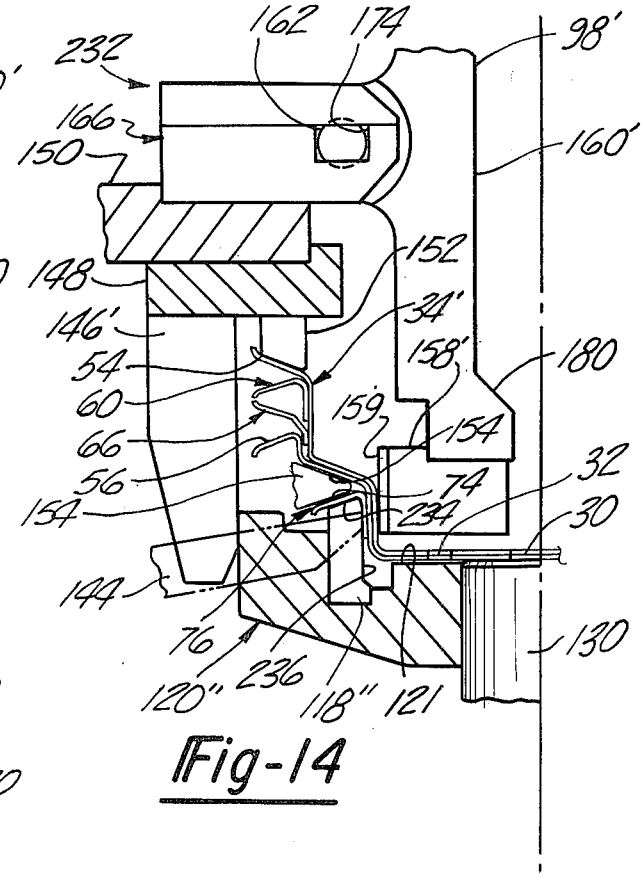

FIGS. 13 and 14 illustrate an apparatus 232 for both pressing ring 76 on a subassembly of cup 36' telescoped over a cup 34' with rings 60 and 66 spot welded thereon, and spot welding ring 76 to both of the cups in accordance with the method of this invention preferably after holes 30 and 32 have been pierced through the bottoms of the cups. Apparatus 232 is generally the same as apparatus 90 and, thus, the description of identical component parts which have the same reference numerals will not be repeated. Apparatus 232 has modified electrodes 158' which are slightly longer to align the pressure pads 159 thereof with the base 78 of ring 76. Welding guns 98 (not shown in FIGS. 13 and 14) are lowered to align their electrode tips 144 with the gase 78 of ring 76 and pressure pads 159 of electrodes 158'.

Carrier ring 120'' of apparatus 232 is constructed to accommodate electrode tips 144, wedges 154, and the subassembly of cups and rings, and locators 146' are elongated to engage carrier ring 120''. Carrier ring 120'' has shorter supports 118'' with upper edges 234 which bear on the flange of ring 76 to position the ring at the desired elevation on cup 36' and side surfaces 236 which bear on the base of ring 76 to center the subassembly of all rings and both cups in carrier ring 120'. Wedges 154 and their associated cylinders 156 are located at a lower position so that when the wedges are extended they will engage with the inclined wall portion 52 of cup 36' and flange 74 of ring 76 to urge the flanges of cup 34' and ring 76 into firm engagement with stops 152 and the upper edges 234 of supports 118'' respectively. The loaded position and welding position of the component parts of apparatus 232 is shown in FIGS. 13 and 14 respectively, and the operation of apparatus 232 is the same as the operation of apparatus 90.

In using the method and apparatus of this invention, it is preferable to pierce holes 30 and 32 in the bottom of cups 34' and 36' before welding ring 76 thereto so that the inner and/or outer peripheries of the side wall portions 42 and 46 of the cups can be used as locating surfaces for aligning the cups and the punches of the piercing dies for piercing the holes before the side wall portions are defaced and distorted by spot welds 80 therein. It is believed that the width of grooves 22, 24, and 26 of pulleys 20 are more readily and economically consistently held within acceptable manufacturing tolerances by using fixed supports 118, 118', and 118'' bearing through their associated carriers on the bottoms of cups 34' and 36' to locate the rings at the desired elevation on the cups, rather than using radially movable spacer wedges extending between the rings and flanges to control the width of the grooves. Producing pulleys 20 with the method and apparatus of this invention improves the balance of the pulleys and the concentricity of the pilot holes 30 and mounting holes 32 with the grooves 22, 24, and 26 of the pulleys. This method and apparatus also produces inherently balanced pulleys which eliminate the necessity of separate balancing operations, thereby decreasing the cost of manufacture and assembly of the pulleys. If desired, pulleys with two grooves of the same or nearly the same pitch diameter can be produced by eliminating ring 76 and pulleys with two grooves of substantially different pitch diameters can be produced by eliminating rings 60 and 66 and modifying one of the cups to position the flanges 54 and 56 of the cups adjacent one another to form one of the grooves. The method and apparatus of this invention also produces pulleys in which the flat mounting surfaces of bottom walls 38 and 40 are not defaced or distorted by any spot welds therein. Thus, true surfaces for mounting the pulley are provided without requiring any machining or restriking operations, thereby decreasing the cost of manufacture of the pulleys.

Having described the method and apparatus of my invention, I claim:

1. The method of producing a stamped sheet metal pulley comprising the steps of:

telescopically interengaging with an interference fit cylindrical first side wall portions of two stamped sheet metal cups, each cup having an integral flat bottom wall portion and an inclined integral annular flange extending generally radially outwardly adjacent the open end thereof, said cups being interengaged such that their bottom wall portions are in abutting co-planar engagement and said annular flanges are spaced apart axially to each define at least in part a groove of the pulley;

arranging said interengaged cups between punch and die means for forming a plurality of mounting holes through the bottom wall portions of both cups by engaging the periphery of the side wall portion of at least one of said interengaged cups with concentrically arranged locating means on the punch and die means;

actuating said punch and die means to form mounting holes through said bottom wall portions of both cups concentric with the central axis of the interengaged cups; and thereafter welding said side wall portions together.

2. The method of claim 1 wherein the step of welding said first side wall portions of said cups together comprises forming a plurality of circumferentially equally spaced spot welds in said side wall portions of said cups.

3. The method of claim 1 which also comprises the steps of telescopically interengaging with an interference fit over a side wall portion of one of said cups an axially extending cylindrical base of a first stamped sheet metal continuous ring having an obliquely inclined integral flange adapted to define in part a groove of the pulley, and welding said base of said first ring to at least said side wall portion of said one cup.

4. The method of claim 3 wherein the step of welding said base of said first ring to at least said side wall portion of said one cup is performed after the step of producing said concentric mounting holes in said bottom walls of said cups by said means.

5. The method of claim 4 wherein the steps of welding said side wall portions together and said first ring to at least said side wall portion of said one cup are performed simultaneously by forming a plurality of circumferentially equally spaced spot welds, each in both said base of said first ring and said side wall portions of both of said cups.

6. The method of claim 4 wherein the other cup has a cylindrical second side wall portion integral with and generally radially offset from said first side wall portion thereof, said second side wall portion being interposed between said flange and said first side wall portion of said other cup, and which also comprises the steps of telescopically interengaging with an interference fit an axially extending cylindrical base of a second stamped sheet metal ring over said second side wall portion of said other cup prior to the step of telescopically interengaging the cups, said second ring having an obliquely inclined integral flange defining in cooperation with said integral flange of said other cup a groove of the pulley, and welding said base of said second ring to said second side wall portion of said other cup.

7. The method of claim 4 wherein said one cup has an obliquely inclined wall portion defining in cooperation with said flange of said first ring a groove of the pulley and which is integral with and interposed between said flange and said first side wall portion of said one cup.

8. The method of claim 6 wherein the step of welding said base of said second ring to said second wall portion of said other cup comprises forming a plurality of circumferentially equally spaced spot welds in said base of said second ring and said second side wall portion of said other cup.

9. The method of claim 6 which also comprises the steps of telescopically interengaging with an interference fit an axially extending cylindrical base of a stamped sheet metal third ring over said second side wall portion of said other cup after the step of telescopically interengaging said second ring over said second side wall portion of said other cup and before the step of telescopically interengaging said cups, said third ring having an obliquely inclined integral flange defining in cooperation with said flange of said one cup a groove of the pulley, and welding said base of said third ring to said second side wall portion of said other cup.

10. The method of claim 9 wherein the step of welding said third ring to said second side wall portion of said other cup comprises forming a plurality of circumferentially equally spaced spot welds in said base of said third ring and said second side wall portion of said other cup.

11. The method of claim 10 wherein said one cup has an obliquely inclined wall portion defining in cooperation with said flange of said first ring a groove of the pulley and which is integral with and interposed between said flange and said first side wall portion of said one cup.

* * * * *